US005999201A

United States Patent [19]

Dalal et al.

[11] Patent Number: 5,999,201

[45] Date of Patent: Dec. 7, 1999

[54] APPARATUS AND METHOD FOR FORMING A TONER IMAGE WITH LOW TONER PILE HEIGHT

[75] Inventors: Edul N. Dalal, Webster; Dan A. Hays, Fairport, both of N.Y.

[73] Assignee: Xerox Corporation, Stamford, Conn.

[21] Appl. No.: 09/004,657

[22] Filed: Jan. 8, 1998

[51] Int. Cl.[6] ..... B41J 2/385; G03G 15/01

[52] U.S. Cl. ..... 347/115; 430/42; 399/296; 399/302; 399/341

[58] Field of Search ..... 399/296, 302, 399/299, 341, 342; 355/405, 406; 347/115; 430/42, 44, 97, 138

[56] References Cited

U.S. PATENT DOCUMENTS

| | | | |
|---|---|---|---|
| 5,176,974 | 1/1993 | Till et al. | 430/42 |
| 5,200,285 | 4/1993 | Carrish | 430/45 |
| 5,737,678 | 4/1998 | Volkers et al. | 399/302 |
| 5,815,779 | 9/1998 | Abramsohn | 399/296 X |
| 5,839,037 | 11/1998 | Larson et al. | 399/302 X |
| 5,890,045 | 3/1999 | Till et al. | 399/308 |

*Primary Examiner*—Matthew S. Smith
*Attorney, Agent, or Firm*—Lloyd F. Bean II

[57] ABSTRACT

An apparatus for forming an image on a recording sheet having low toner pile height is disclosed. A latent image is formed on an imaging member. A developer unit develops the latent image with a less than monolayer of toner particles on the imaging member. The developed image is transferred to a compliant intermediate member whereupon a filming station spreads the toner particles to form a film layer. The station includes a heater for heating the less than monolayer of toner particles to a temperature sufficient to cause the toner particles present on the intermediate member to soften; and a roller for spreading the less than a monolayer of toner particles to generate the thin film layer. The above process is repeated for subsequent colored toners to produce a multi film layer color image. Thereafter, the multi film layer color image is transferred from the intermediate member onto a recording sheet.

4 Claims, 2 Drawing Sheets

APPARATUS AND METHOD FOR FORMING A TONER IMAGE WITH LOW TONER PILE HEIGHT

This invention relates generally to development of dry toner images wherein the resultant image on a recording sheet exhibits low toner pile height.

BACKGROUND AND SUMMARY OF THE INVENTION

A typical electrostatographic printing machine (such as a photocopier, laser printer, facsimile machine or the like) employs an imaging member that is exposed to an image to be printed. Exposure of the imaging member records an electrostatic latent image on it corresponding to the informational areas contained within the image to be printed. The latent image is developed by bringing a developer material into contact therewith. The developed image recorded on the photoconductive member is transferred to a support material such as paper either directly or via an intermediate transport member. The developed image on the support material is generally subjected to heat and/or pressure to permanently fuse it thereto.

Two types of developer materials are typically employed in electrostatographic printing machines. One type of developer material is known as a dry developer material and comprises toner particles or carrier granules having toner particles adhering triboelectrically thereto. Another type of developer material is a liquid developer material comprising a liquid carrier or dispersant having toner particles dispersed therein.

Development with liquid developers in full color imaging processes has many advantages, such as a texturally attractive print because there is substantially no toner height build-up, whereas full color images developed with dry toners often exhibit height build-up of the image where color areas overlap. Further, full color prints made with liquid developers can be made to have either a uniformly glossy or a uniformly matte finish, whereas uniformity of finish is difficult to achieve with powder toners because of variations in the toner pile height.

High toner pile height is a major document appearance problem for powder xerography. It is obvious to the customer not only as increased document thickness but also in other undesirable ways, such as paper curl. In addition to being an aesthetic dissatisfier, paper distortion due to curl and ripple increases the jam rate and complicates paper handling and document finishing. This is objectionable in any market, but especially in the production color printing market, which demands high-speed reliable operation and is accustomed to the look and feel of lithography.

Toner pile height can be reduced by reducing toner size, but the performance of current xerographic subsystem designs would be compromised for average particle sizes less than about 5 $\mu$m. On the other hand, in conventional systems, if toner mass is reduced without reducing toner size, the toner does not completely cover the paper even in the Dmax areas. Incomplete paper coverage leads to significant color and image quality degradation, since even a small amount of white light from bare paper can reduce image chroma noticeably. This is particularly severe for high-chroma and/or low-lightness colors, such as deep blue.

A need exists for an electrostatic printing machine that can produce texturally attractive color prints with substantially no height build-up employing dry developers. A simple, relatively inexpensive, and accurate approach to produce color prints in such printing systems has been a goal in the design, manufacture and use of electrophotographic printers. This need has been particularly recognized in the process color and highlight color portion of electrophotography. The need to provide accurate and inexpensive color reproduction with dry developers has become more acute, as the demand for high quality, relatively inexpensive color images and the machines that produce them have increased.

The present invention obviates the problems noted above by utilizing an apparatus for forming an image on a recording sheet having low toner pile height. A latent image is formed on an imaging member. A developer unit develops the latent image with a less than monolayer of toner particles on the imaging member. The developed image is transferred to a compliant intermediate member whereupon a filming station spreads the toner particles to form a film layer from the toner particles. The station includes an optional heater for heating said monolayer of toner particles to a temperature sufficient to cause the toner particles present on the intermediate member to soften; and a heated roller for spreading said monolayer of toner particles to generate said film layer. The above process is repeated for subsequent colored toners to produce a multi-film layer color image. Thereafter, the multi-film layer of toner material is transfused from said intermediate member onto a recording sheet such as paper.

The present invention will be described in connection with preferred embodiments; however, it will be understood that there is no intent to limit the invention to the embodiments described. On the contrary, the intent is to cover all alternatives, modifications, and equivalents as may be included within the spirit and scope of the invention as defined by the appended claims.

DESCRIPTION OF THE PREFERRED EMBODIMENT

Figure 1:
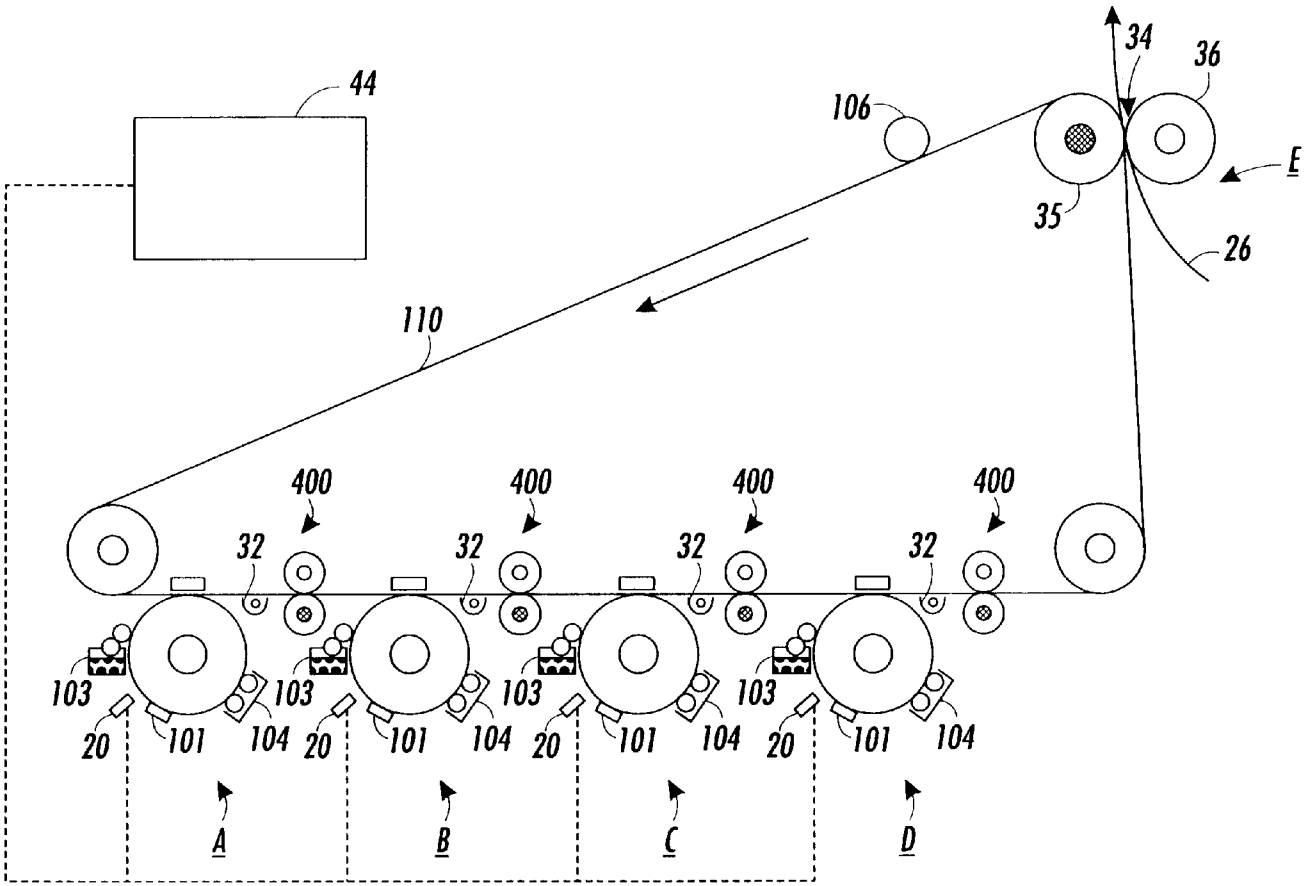
FIG. 1 is an illustration of a multicolor printing machine incorporating the present invention.

Turning now to FIG. 1, there is shown a color document imaging system incorporating the present invention. An image processing unit 44 generates a color image. Digital signals which represent the blue, green, and red density signals of the image are converted in the image processing unit into four bitmaps: yellow (Y), cyan (C), magenta (M), and black (K). The bitmap represents the values of the exposure required for each color component of the pixel. Image processing unit 44 may contain a shading correction unit, an undercolor removal unit (UCR), a masking unit, a dithering unit, a gray level processing unit, and other imaging processing sub-systems known in the art. The image processing unit 44 can store bitmap information for subsequent images or can operate in a real time mode.

At stage A, toner of a first color is formed on either a belt or drum 100. The photoconductive member is preferably a drum of the type which is typically multilayered and has a substrate, a conductive layer, an optional adhesive layer, an optional hole blocking layer, a charge generating layer and a charge transport layer. The drum is charged by charging unit 101. Raster output scanner (ROS) 20, controlled by image processing unit 44, writes a first color image by selectively erasing charges on the drum 100. The ROS 20 writes the image information pixel by pixel. It should be noted that either discharged area development (DAD) can be employed in which discharged portions are developed or charged area development (CAD) can be employed in which the charged portions are developed with toner.

After the electrostatic latent image has been recorded, drum 100 advances the electrostatic latent image to development station 103. Dry developer material is supplied by development station 103 to develop the latent image. In the case of CAD development, the charge of the toner particles is opposite in polarity to the charge on the photoconductive surface, thereby attracting toner particles thereto. The latent image is developed with a less than monolayer coverage of toner particles. On the average, the uniformity of the development is such that toner particles are near neighboring toner particles. Development station 103 employs small size toner, preferably having average particle size of about 5 $\mu$m.

Figure 2:
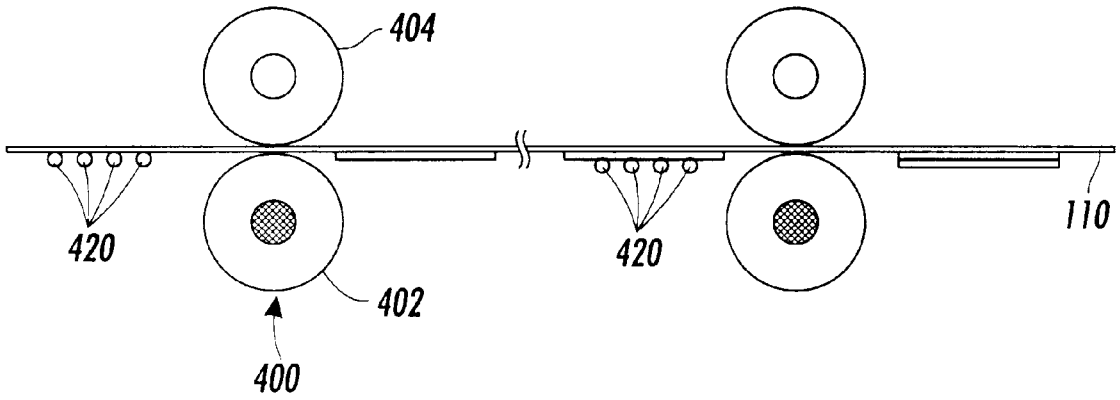
FIG. 2 is a schematic illustration of the film layer formation process employed in the present invention.

The developed image is electrostatically transferred to the compliant, low surface energy intermediate member by applying an electrical bias between the drum 100 and intermediate member 110. Any residual toner on the drum 100 is removed with a cleaner 104. Intermediate member 110 may be either a roll or an endless belt with a conductive substrate and a compliant overcoat. The path of the belt is defined by a plurality of internal rollers. Intermediate member 110 includes an optional plurality of heating elements 32 in close proximity to the toned image such that the heat causes the toner particles present on the surface to soften, as illustrated by the particles 420 in FIG. 2. As indicated in FIG. 2, the softened toner particles pass through film layer formation station 400. Station 400 includes a heated roller 402 which is in contact with the softened toner image and a backup pressure roll 404 behind intermediate member 110. Filming station 400 spreads the softened toner particles into a thin film so that the small gaps between neighboring toner particles are covered with toner without degradation of the image. The toner flow required is very small to cover the spaces between the toner particles. Ideally, the film forming station should form a film of the desired thickness (about 1 $\mu$m) regardless of the local toner coverage. One possible way of achieving this is to make the heated roller 402 self-spaced from the intermediate belt at the desired thickness. One method for achieving this requirement would be to utilize a gravure-type roll for 402.

At stage B illustrated in FIG. 1, formation of a second color takes place in the same manner as described above. The drum 100 is charged with charging unit 101. The belt is exposed by ROS 20 according to second color image bitmap information. After the electrostatic latent image has been recorded, drum 100 advances the electrostatic latent image to development station 103. Dry developer material with toner of the second color is supplied by development station 103 to develop the latent image.

The developed image is electrostatically transferred to the intermediate member by an electrical bias voltage between drum 100 and belt 110. (Any residual toner on drum 100 is cleaned by 104.) The developed second color image is superimposed on the previous first color image. Heat from the optional heater 32 softens the toner particles. The softened toner particles on the intermediate member 110 pass through the heated filming station 400 which spread the softened image into a thin film without degradation of the image.

The process is repeated for the next two colors at stages C and D. A multi-layer film image is formed by superimposing black, yellow, magenta, and cyan toners. The full-color image advances to transfusing stage E.

At transfuse nip 34 illustrated in FIG. 1, the multi-layer full-color film image is transfused to the recording sheet 26 by the application of heat and pressure between a heated roll 35 behind the intermediate belt 110 and a backup pressure roll 36 behind the recording sheet. Moreover, recording sheet 26 may have a previously transferred toner image present on the back surface thereof as the result of a prior imaging operation, i.e. duplexing. As the recording sheet passes through the transfuse nip, the multi-layer toner film adheres to the surface of the recording sheet, and due to greater attractive forces between the paper and toner film, as compared to the attraction between the toner film and the low surface energy surface of the compliant intermediate member 110, the multilayer toner film is transferred to the recording sheet as a full-color image. The transfused image becomes permanent once it advances past the transfuse nip and is allowed to cool below the softening temperature of the toner materials. The cycle for forming another document is initiated following the cleaning of any residual toner from the intermediate belt by a cleaner 106.

The advantages of the present invention are as follows:

Because the toner spreading is conducted on a controlled substrate such as an intermediate belt, problems are avoided with unknown paper properties such as rough surfaces, incompatible surface chemistry, etc.

Because the toner spreading is not conducted on paper, there are no concerns with introducing excessive curl, cockle, etc., by applying potentially high temperature and pressure to the recording sheet. In fact, it might be possible to apply significantly less heat to the recording sheet than is done in current fusing conditions, since the toner would be fused before application to the recording sheet.

Transfusing a toner film enables essentially 100% transfer. This eliminates image quality problems such as "transfer mottle", which is due to incomplete and non-uniform transfer of toner to the recording sheet. It may also enable a cleanerless design, if there is no toner left to clean off the intermediate belt.

Transferring a toner film to the recording sheet results in an image which is very uniform in thickness. On the other hand, when dry powder is normally electrostatically transferred to rough recording sheet such as paper, there is less toner on the paper peaks and more in the valleys. This leads to a grainy image due to color variation.

Transferring a toner film to a recording sheet such as paper results in an image which has very uniform gloss. On the other hand, when dry powder is fused on rough paper, more heat and pressure is applied on the paper peaks than in the valleys. This leads to micro-gloss, an objectionable variation in image gloss.

Because the toner spreading is conducted on an intermediate substrate, it is possible to do this after each color separation (C, M, Y, K), as illustrated in FIG. 2. This is important in the case of colors involving more than one primary toner (e.g., Red=M+Y) because if both M and Y are developed at incomplete coverage before the spreading operation, the resulting toner film would have M and Y patches beside each other, rather than overlapping parallel films of each toner. If toner spreading is carried out on paper it is highly impractical to do this after each separation.

It is, therefore, apparent that there has been provided, in accordance with the present invention, a method and apparatus for producing a transferable image directly on a compliant intermediate member. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A multi-color image printing apparatus for forming a full-color image on a recording sheet, comprising:

means for forming a less than monolayer of toner particles of one color separation on an intermediate member;

a filming station for spreading toner particles to form a film layer;

means for superimposing a similarly formed additional color separation on said one color separation to form a multi film layer color image film on said intermediate member and transfusing said multi film layer color image from said intermediate member onto a recording sheet.

2. The apparatus of claim 1, wherein said film forming stations include:

means for heating said less than monolayer of toner particles to a temperature sufficient to cause the toner particles present on the intermediate member to soften;

a heated roller for forming a film layer by spreading toner particles with less than a monolayer coverage.

3. The apparatus of claim 2, wherein the heated roller of the film forming stations is a gravure-type roller.

4. The apparatus of claim 1, wherein said intermediate member is compliant and of low surface energy.

* * * * *